US009357326B2

(12) United States Patent
Radhakrishnan et al.

(10) Patent No.: US 9,357,326 B2
(45) Date of Patent: May 31, 2016

(54) EMBEDDING DATA IN STEREO AUDIO USING SATURATION PARAMETER MODULATION

(71) Applicant: DOLBY LABORATORIES LICENSING CORPORATION, San Francisco, CA (US)

(72) Inventors: Regunathan Radhakrishnan, Foster City, CA (US); Mark F. Davis, Pacifica, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/412,882

(22) PCT Filed: Jul. 3, 2013

(86) PCT No.: PCT/US2013/049358
§ 371 (c)(1),
(2) Date: Jan. 5, 2015

(87) PCT Pub. No.: WO2014/011487
PCT Pub. Date: Jan. 16, 2014

(65) Prior Publication Data

US 2015/0163614 A1 Jun. 11, 2015

Related U.S. Application Data

(60) Provisional application No. 61/670,816, filed on Jul. 12, 2012.

(51) Int. Cl.

| | |
|---|---|
| ***H04R 5/00*** | (2006.01) |
| ***H04S 7/00*** | (2006.01) |
| ***G10L 19/018*** | (2013.01) |
| ***H04S 1/00*** | (2006.01) |

(52) U.S. Cl.
CPC ..... *H04S 7/30* (2013.01); *G10L 19/018* (2013.01); *H04S 1/00* (2013.01); *H04S 2420/03* (2013.01)

(58) Field of Classification Search
CPC ..... H04S 1/002; H04R 5/02; H04R 5/033; H04R 5/027; H04R 5/04; H04R 25/04; H04R 3/12; H03G 3/32; H03F 3/68
USPC ..... 381/1, 17, 300, 309, 26, 28, 319, 57, 381/84, 120
See application file for complete search history.

(56) References Cited

U.S. PATENT DOCUMENTS

| | | | |
|---|---|---|---|
| 7,974,840 | B2 | 7/2011 | Kim |
| 8,041,041 | B1 | 10/2011 | Luo |

(Continued)

FOREIGN PATENT DOCUMENTS

| | | | |
|---|---|---|---|
| JP | 2006-227330 | 8/2006 | |
| NL | WO 2009107054 A1 * | 9/2009 | ..... G10L 19/008 |
| WO | 2009/107054 | 9/2009 | |

OTHER PUBLICATIONS

Chou, J. et al. "Audio Data Hiding with Application to Surround Sound" IEEE Acoustics, Speech, and Signal Processing, vol. 2, pp. 337-340, Apr. 6-10, 2003.

(Continued)

*Primary Examiner* — Akelaw Teshale

(57) ABSTRACT

In some embodiments, a method for embedding data (e.g., metadata for use during post-processing) in a stereo audio signal comprising frames. Each of the frames has a saturation value, and data are embedded in the stereo audio signal by modifying the signal to generate a modulated stereo audio signal comprising a sequence of modulated frames having modulated saturation values indicative of the embedded data. Typically, one data bit is embedded in each frame of an input stereo audio signal by modifying the frame to produce a modulated frame whose modulated saturation value matches a target value indicative of the data bit. In other embodiments, a method for extracting data from a stereo audio signal in which the data have been embedded in accordance with an embodiment of the inventive embedding method. Other aspects are systems (e.g., programmed processors) configured to perform any embodiment of the inventive method.

20 Claims, 5 Drawing Sheets

(56) References Cited

U.S. PATENT DOCUMENTS

| | | | | |
|---|---|---|---|---|
| 8,170,883 | B2 * | 5/2012 | Oh | G10L 19/008 704/500 |
| 2004/0070523 | A1 * | 4/2004 | Craven | G11B 20/00992 341/50 |
| 2008/0212803 | A1 * | 9/2008 | Pang | G10L 19/008 381/119 |
| 2014/0294200 | A1 * | 10/2014 | Baumgarte | H03G 3/20 381/107 |

OTHER PUBLICATIONS

Kondo, Kazuhiro "A Data Hiding Method for Stereo Audio Signals Using Interchannel Decorrelator Polarity Inversion" J. Audio Engineering Society, vol. 59, No. 6, Jun. 2011, pp. 379-395.

Liu, Yi-Wen, et al "Watermarking Sinusoidal Audio Representations by Quantization Index Modulation in Multiple Frequencies" IEEE International Conference on Acoustics, Speech, and Signal Processing, May 17-21, 2004, v-373-6, vol. 5.

Nishimura Ryouichi "Information Hiding into Interaural Phase Differences for Stereo Audio Signals" 2009 Fifth International Conference on Intelligent Information Hiding and Multimedia Signal Processing, Sep. 12-14, 2009, pp. 1189-1192.

Nishimura, R. et al. "Multiple Watermarks for Stereo Audio Signals Using Phase-Modulation Techniques" IEEE Transaction on Signal Processing, vol. 53, No. 2, Feb. 1, 2005, pp. 806-815.

Chen, B. et al "Quantization Index Modulation: A Class of Provably Good Methods for Digital Watermarking and Information Embedding" IEEE Transactions on Information Theory, vol. 47, No. 4, May 1, 2001, p. 1428-1429.

* cited by examiner

EMBEDDING DATA IN STEREO AUDIO USING SATURATION PARAMETER MODULATION

CROSS-REFERENCE TO RELATED APPLICATIONS

This application claims priority to U.S. Provisional Patent Application No. 61/670,816 filed 12 Jul. 2012, which is hereby incorporated by reference in its entirety.

TECHNICAL FIELD

The invention relates to methods and systems for embedding (e.g., hiding) data in a stereo audio signal. In typical embodiments of the invention, data are embedded in a stereo audio signal (comprising frames of audio data) by modulating saturation values of the frames.

BACKGROUND

The expression "saturation value" of a two-channel (stereo) audio signal is used herein to denote the value of a parameter indicative of a spatial attribute of (e.g., balance between) the two audio channels indicated by the signal. For convenience, we denote the two channels of a stereo audio signal herein as "Left" and "Right" channels, although we contemplate that a stereo audio signal may comprise two audio channels that are not rendered as left and right channels. For example, any two channels of a five-channel audio signal (e.g., Left and Left Surround, or Right and Right Surround, or Left Surround and Center) may be referred to herein as a stereo audio signal comprising "Left" and "Right" channels.

Examples of the "saturation value" of a frame of stereo audio data include (but are not limited to) values indicative of one of the following spatial attributes of the frame:

strength of the dominant signal component (i.e., the dominant one of the two audio channels indicated by the frame) relative to the strength of the ambient signal component (i.e., the non-dominant one of the two audio channels). This attribute is sometimes referred to as the "saturation" of the frame;

LR saturation: strength of the Left channel of the frame relative to the strength of the Right channel of the frame (i.e., a value indicative of Left-Right balance in the stereo mix); and SD saturation: strength of a Front channel (determined by the Left and Right channels) of the frame relative to the strength of a Back channel (also determined by the Left and Right channels) of the frame (i.e., a value indicative of Front-Back balance in the stereo mix). For example, the Front channel may comprise samples each of which is the sum of corresponding samples of the Left and Right channels, and the Back channel may comprise samples each of which is the difference between corresponding samples of the Left and Right channels.

Steganography is the technique of sending hidden messages, e.g., by embedding hidden messages in data. Steganographic methods have been used for embedding messages in audio data and other data.

However, until the present invention it had not been known how to embed data in a stereo audio signal comprising frames of audio data by modulating saturation values of the frames. In accordance with typical embodiments of the invention, data are embedded in a stereo audio signal (comprising frames of audio data) by modulating saturation values of the frames, without introducing significant audible artifacts into the signal, and in a manner robust to wideband gain change and resampling (e.g., sample rate conversion) attacks.

BRIEF DESCRIPTION OF EXEMPLARY EMBODIMENTS

In a first class of embodiments, the invention is a method for embedding data (e.g., metadata for use during post-processing) in a stereo audio signal comprising a sequence of frames (typically, a stereo audio file comprising a sequence of frames of audio data). Each of the frames has a saturation value, and data are embedded (e.g., hidden) in the stereo audio signal by modifying the signal to generate a modulated stereo audio signal comprising a sequence of modulated frames having modulated saturation values indicative of the data. Typically, one data bit is embedded in each of the frames by modifying the frame to produce a modulated frame whose modulated saturation value matches (i.e., is at least substantially equal to) a target value indicative of the data bit.

In typical embodiments, the range of possible saturation values for each frame is quantized into segments (e.g., M segments, each having width $\Delta$). Two sets of quantized saturation values are determined: a first set of quantized saturation values including a first quantized value in each of the segments; and a second set of quantized saturation values including a second quantized value in each of the segments. Thus, the "j"th segment, where "j" is an index ranging from 0 through M−1, includes a first quantized value, $r_j^0$ and a second quantized value, $r_j^1$. To modulate a frame of the input stereo signal to embed a binary bit of a first type (e.g., a "0" bit) therein, a saturation value of the frame is determined, and the frame is modified to generate a modulated frame having a modulated saturation value, such that the modulated saturation value matches (i.e., is at least substantially equal to) one said first quantized saturation value (e.g., such that the modulated saturation value matches an element of the first set of quantized saturation values which is nearest to the frame's saturation value). To modulate a frame of the input stereo signal to embed a binary bit of a second type (e.g., a "1" bit) therein, a saturation value of the frame is determined, and the frame is modified to generate a modulated frame having a modulated saturation value, such that the modulated saturation value matches (i.e., is at least substantially equal to) one said second quantized saturation value (e.g., such that the modulated saturation value matches an element of the second set of quantized saturation values which is nearest to the frame's saturation value).

In typical embodiments in the first class, the range of possible saturation values (for each frame) is quantized into M segments, each including a representative value, $r_j$ (where "j" is an index ranging from 0 through M−1), and having width $\Delta$ (i.e., having width at least substantially equal to $\Delta$). Two sets of quantized saturation values are determined: a first set of quantized saturation values including a first quantized value in each of the segments; and a second set of quantized saturation values including a second quantized value in each of the segments. The first quantized value in each of the segments is equal to $r_j+\Delta_2$, and the second quantized value in each of the segments is equal to $r_j-\Delta_2$. Typically, $\Delta_2$ is at least substantially equal to $\Delta/4$, and the representative value, $r_j$, of the "j"th segment is the median of the saturation values in the segment. To embed a binary bit of a first type (e.g., a "0" bit) in a frame of the input stereo signal (the "i"th frame), a saturation value of the frame is determined (i.e., the saturation value of the frame is determined to be within the "j"th quantization segment), and the frame is modified to generate a modulated frame having a modulated saturation value, such that the modulated saturation value matches one said first quantized saturation value (e.g., such that the modulated saturation value matches the element of the first set of quantized saturation values in the "j"th or the "j+1"th segment). To embed a binary bit of a second type (e.g., a "1" bit) in a frame of the input stereo signal (the "i"th frame), a saturation value of the frame is determined (i.e., the saturation value of the frame is determined to be within the "j"th quantization segment), and the frame is modified to generate a modulated frame having a modulated saturation value, such that the modulated saturation value matches one said second quantized saturation value (e.g., such that the modulated saturation value matches the element of the second set of quantized saturation values in the "j"th or the "j−1"th segment).

Typically, the saturation value of each frame of the input stereo audio file (and the modulated saturation value of each frame of the modulated stereo audio file generated in response to the input stereo audio file) is indicative of one of the following three spatial attributes of the frame:

Saturation: a value indicative of relative strength of dominant signal component (i.e., the dominant one of the Left and Right channels) to ambient signal component (i.e., the non-dominant one of the Left and Right channels);

LR saturation: a value indicative of Left-Right balance in the stereo mix; and

SD saturation: a value indicative of Front-Back balance in the stereo mix.

Typical embodiments of the inventive method and system have a data embedding capacity of about 500 bits per second, and are robust against wideband gain change and resampling attacks.

A typical method in the first class includes a preliminary step of:

windowing each channel of each frame of the input audio signal, thereby generating a windowed stereo signal comprising a sequence of windowed frames, so as to prevent the modulated frames (later generated from the windowed frames rather than from the original frames of the input audio signal) from exhibiting audible discontinuities across frame boundaries when the modulated frames are rendered. Typically the window is a flat-top window having tapered end portions at the frame boundaries.

The windowed signal can further be filtered and downsampled (e.g., to 8 kHz so that the calculated saturation value is dependent on spatial attributes of frequency components up to 4 kHz. If the original stereo signal is sampled at 48 kHz, this step ensures that the calculated saturation value is the same even if the modified stereo signal is resampled down to 8 kHz).

A saturation value is then determined from each windowed frame, a target saturation value (e.g., an element of the first set of quantized saturation values or the second set of quantized saturation values) is determined for the saturation value, and the windowed frame is modified to generate a modulated frame having a modulated saturation value, such that the modulated saturation value is the target saturation value for the windowed frame.

In embodiments in which one data bit is embedded in each frame (of at least a subset of the frames of an input stereo audio signal) by modifying the frame to produce a modulated frame whose modulated saturation value matches a target value indicative of the data bit, the modification of each frame includes steps of applying a gain, "g," to a first modification signal to produce a first scaled signal, adding the first scaled signal to a first channel signal indicative of a first channel (e.g., the Left channel) of the frame, applying the gain to a second modification signal to produce a second scaled signal, and adding the second scaled signal to a second channel signal indicative of audio samples comprising a second channel (e.g., the Right channel) of the frame. The first channel signal is indicative of (e.g., consists of) the audio samples comprising the first channel of the frame, and the second channel signal is indicative of (e.g., consists of) the audio samples comprising the second channel of the frame. In some such embodiments, the first modification signal is the sum of the second channel signal and the Hilbert transform of the second channel signal, and the second modification signal is the sum of the first channel signal and the Hilbert transform of the first channel signal. In some embodiments, the gain ("g") is determined using an iterative algorithm, so that the step of modifying the frame is an iterative process. Alternatively, the gain ("g") is computed in closed form, and the step of modifying the frame is a non-iterative process.

A typical method in the first class also includes a final step of overlap adding the modulated frames to generate output modulated frames of stereo audio data indicative of the embedded data.

Another aspect of the invention is a system configured to perform any embodiment of the inventive data embedding method on an input stereo audio signal (e.g., an input stereo audio file) comprising a sequence of frames.

In a second class of embodiments, the invention is a method for extracting data from a stereo audio signal (in which the data have been embedded in accordance with an embodiment of the invention). The method assumes that the stereo audio signal has been generated by modifying frames of an input (unmodulated) stereo signal to embed binary bits therein, including by modifying at least one frame of the input stereo signal to embed a binary bit of a first type by modifying the frame to generate a modulated frame having a modulated saturation value which matches a first target value (e.g., a target value in a first set of target values), and by modifying at least one frame of the input stereo signal to embed a binary bit of a second type therein by modifying the frame to generate a modulated frame having a modulated saturation value which matches a second target value (e.g., a target value in a second set of target values, and the method includes the steps of:

(a) determining a saturation value from each frame of the stereo audio signal;

(b) extracting a binary bit of the first type from each frame of the stereo audio signal whose saturation value matches a first target value (e.g., a target value in a first set of target values); and (c) extracting a binary bit of the second type from each frame of the stereo audio signal whose saturation value matches a second target value (e.g., a target value in a first set of target values).

Typically, the method assumes that the stereo audio signal has been generated by modifying frames of an input stereo signal to embed binary bits therein, including by modifying at least one frame of the input stereo signal to embed a binary bit of a first type therein by modifying the frame to generate a modulated frame having a modulated saturation value such that the modulated saturation value is an element of a first set of quantized saturation values (e.g., an element of the first set of quantized saturation values which is nearest to the frame's saturation value), and by modifying at least one frame of the input stereo signal to embed a binary bit of a second type (e.g., a "1" bit) therein by modifying the frame to generate a modulated frame having a modulated saturation value such that the modulated saturation value is an element of a second set of quantized saturation values (e.g., an element of the second set of quantized saturation values which is nearest to the frame's saturation value), and includes the steps of:

(a) determining a saturation value from each frame of the stereo audio signal;

(b) extracting a binary bit of the first type from each frame of the stereo audio signal whose saturation value is an element of the first set of quantized saturation values; and (c) extracting a binary bit of the second type from each frame of the stereo audio signal whose saturation value is an element of the second set of quantized saturation values.

For example, step (b) may include a step of extracting a binary bit of the first type from the frame in response to determining that the closest element of the first set of quantized saturation values and the second set of quantized saturation values, to the saturation value determined in step (a) from said frame, is an element of the first set of quantized saturation values, and step (c) may include a step of extracting a binary bit of the second type from the frame in response to determining that the closest element of the first set of quantized saturation values and the second set of quantized saturation values, to the saturation value determined in step (a) from said frame, is an element of the second set of quantized saturation values.

Optionally, the method includes a preliminary step of windowing each channel of each frame of the input audio signal, thereby generating a windowed stereo signal comprising a sequence of windowed frames, so as to prevent the modulated frames (later generated from the windowed frames rather than from the original frames of the input audio signal) from exhibiting audible discontinuities across frame boundaries when the modulated frames are rendered. Typically the window is a flat-top window having tapered end portions at the frame boundaries.

The windowed signal can further be filtered and downsampled (e.g., to 8 kHz so that the calculated saturation value is dependent on spatial attributes of frequency components up to 4 kHz. If the original stereo signal is sampled at 48 kHz, this step ensures that the calculated saturation value is the same even if the modified stereo signal is resampled down to 8 kHz).

Another aspect of the invention is a system configured to perform any embodiment of the inventive data extraction method.

It has been determined that in typical embodiments the quantization step size $\Delta$ should be 0.01 or less, assuming that the saturation value has a range from 0 to 1, in order for audio data modification in accordance with the invention to be inaudible.

Also, it has been determined that in typical embodiments an overlap adding step with a 75% flat-top window helps to mask the discontinuities (in saturation value) introduced into audio (in accordance with the invention) across frame boundaries.

Also, it has been determined that data should typically not be embedded in regions (segments) of an input stereo signal for which the saturation value is already either too high (e.g., greater than 0.98) or too low (e.g., less than 0.02). The signal selection needed to implement this should be done in a way that is same in the embedded data extractor and the data embedder.

In typical embodiments, the inventive data embedding method achieves a very high embedding capacity (e.g., about 500 bps) based on modulation of a stereo saturation value. Typically, the modulation is performed to produce modulated audio frames having quantized saturation values (so that a modulated frame having a quantized saturation value which is an element of a first set of quantized values is indicative of an embedded bit which is a first binary bit (e.g., a "0" bit), and a modulated frame having a quantized saturation value which is an element of a second set of quantized values is indicative of an embedded bit which is a second binary bit (e.g., a "1" bit)), and the modification to the input stereo signal is achieved by an iterative process (in which the iteration ends when the saturation value of the signal frame being modified matches the corresponding target saturation value). In typical embodiments, the data embedding method is robust to wideband gain change and sample rate conversion, although it may not be robust to audio coding or other processing which disturbs the relationship between the Left and Right channels of the modified stereo signal.

Typical embodiments of the inventive data embedding method are useful to convey metadata from an audio signal decoder to an audio post-processor (e.g., a post-processor in the same product as the decoder). In such embodiments, the decoder implements the inventive data embedding system (e.g., as a subsystem of the decoder), and the post-processor implements the inventive system for extracting the embedded data (e.g., as a subsystem of the post-processor). The post-processor (or the decoder and post-processor) may be a set-top box, a computer operating system (e.g., a Windows OS or Android OS), or a system or device of another type. Using the metadata which have been embedded in accordance with the invention (in the decoder), the post-processor can adapt accordingly. For example, metadata may be embedded in a stereo audio signal (in accordance with the invention) periodically (e.g., once per second), and the metadata may be indicative of the type of audio content (e.g., voice or music) of the stereo audio signal, and/or the metadata may be indicative of whether upmixing or loudness processing has been performed on the stereo audio signal.

The invention may be implemented in software (e.g., in an encoder, a decoder, or a post-processor that is implemented in software), or in hardware or firmware (e.g., in a digital signal processor implemented as an integrated circuit or chip set).

In some embodiments, the inventive method for embedding (e.g., hiding) data in stereo audio is combined with at least one monophonic data hiding method to achieve increased data embedding capacity. For example, a modified stereo audio signal comprising modified frames (having modulated saturation values) is generated in response to two channels of an input multi-channel audio signal to embed a first data stream in at least a subset of the modified frames, and an additional data stream is embedded in one of the channels of the modified stereo signal. The other channel of the modified stereo signal may be modified to ensure that the final stereo signal (in which both data streams have been embedded) has the same saturation values as does the modified stereo signal (in which only the first data stream has been embedded). The additional data stream may be embedded by a frequency-shift key ("FSK") modulation method or any other method. One example of a method for embedding the additional data stream is an FSK modulation method in which one of the following operations is performed on each frame of one channel of the modified stereo signal:

applying a notch filter centered at a first frequency (e.g., 15.1 kHz) and adding (to the resulting notch-filtered signal) a sinusoidal signal whose frequency is the first frequency and whose amplitude is the average amplitude of the samples of the frame (or the average amplitude of the samples of the frame in a narrow frequency band centered at the first frequency) to embed a first binary bit (e.g., a "zero" bit) of the second data stream in the frame; or applying a notch filter centered at a second frequency (e.g., 15.2 kHz) and adding (to the resulting notch-filtered signal) a sinusoidal signal whose frequency is the second frequency and whose amplitude is the average amplitude of the samples of the frame (or the average amplitude of the samples of the frame in a narrow frequency band centered at the second frequency) to embed a second binary bit (e.g., a "one" bit) of the second data stream in the frame.

Aspects of the invention include a system configured (e.g., programmed) to perform any embodiment of the inventive method, and a computer readable medium (e.g., a disc) which stores code for implementing any embodiment of the inventive method. The invention may be implemented in software (e.g., in an encoder or a decoder that is implemented in software), or in hardware or firmware (e.g., in a digital signal processor implemented as an integrated circuit or chip set).

In typical embodiments, the inventive system is or includes a general or special purpose processor programmed with software (or firmware) and/or otherwise configured to perform an embodiment of the inventive method. In some embodiments, the inventive system is a general purpose processor (e.g., a general purpose processor or digital signal processor implementing elements 2, 4, 6, 8, and 10 of FIG. 1), coupled and configured (e.g., programmed) to generate a modulated audio output signal (e.g., the stereo audio signal output from element 10 of FIG. 1) in response to an input stereo audio signal (e.g., the stereo audio signal input to element 2 of FIG. 1) by performing an embodiment of the inventive embedding method. In some embodiments, the inventive system is a processor (e.g., a general purpose processor or digital signal processor implementing elements 12, 14, and 16 of FIG. 4), coupled and configured (e.g., programmed) to extract embedded data (e.g., the data output from element 16 of FIG. 4) from an input stereo audio signal (e.g., the stereo audio signal input to element 12 of FIG. 4), where the data have been embedded in the input stereo audio signal in accordance with an embodiment of the inventive embedding method.

Aspects of the invention include a system configured (e.g., programmed) to perform any embodiment of the inventive method, and a computer readable medium (e.g., a disc) which stores code for implementing any embodiment of the inventive method.

NOTATION AND NOMENCLATURE

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal;

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone. The desired position can be static, as is typically the case with physical loudspeakers, or dynamic;

audio program: a set of one or more audio channels and optionally also associated metadata that describes a desired spatial audio presentation;

render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization (or upmixing) techniques designed to be substantially equivalent (for the listener) to such trivial rendering. In this latter case, each audio channel may be converted to one or more speaker feeds to be applied to loudspeaker(s) in known locations, which are in general (but may not be) different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis. Examples of such upmixing techniques include ones from Dolby (Pro-logic type) or others (e.g., Harman Logic 7, Audyssey DSX, DTS Neo, etc.);

azimuth (or azimuthal angle): the angle, in a horizontal plane, of a source relative to a listener/viewer. Typically, an azimuthal angle of 0 degrees denotes that the source is directly in front of the listener/viewer, and the azimuthal angle increases as the source moves in a counter clockwise direction around the listener/viewer;

elevation (or elevational angle): the angle, in a vertical plane, of a source relative to a listener/viewer. Typically, an elevational angle of 0 degrees denotes that the source is in the same horizontal plane as the listener/viewer, and the elevational angle increases as the source moves upward (in a range from 0 to 90 degrees) relative to the viewer;

L: Left front audio channel. A speaker channel, typically intended to be rendered by a speaker positioned at about 30 degrees azimuth, 0 degrees elevation;

C: Center front audio channel. A speaker channel, typically intended to be rendered by a speaker positioned at about 0 degrees azimuth, 0 degrees elevation;

R: Right front audio channel. A speaker channel, typically intended to be rendered by a speaker positioned at about −30 degrees azimuth, 0 degrees elevation;

Ls: Left surround audio channel. A speaker channel, typically intended to be rendered by a speaker positioned at about 110 degrees azimuth, 0 degrees elevation;

Rs: Right surround audio channel. A speaker channel, typically intended to be rendered by a speaker positioned at about −110 degrees azimuth, 0 degrees elevation; and Front Channels: speaker channels (of an audio program) associated with frontal sound stage. Typical front channels are L and R channels of stereo programs, or L, C and R channels of surround sound programs.

Furthermore, the fronts could also involve other channels driving more loudspeakers (such as SDDS-type having five front loudspeakers), there could be loudspeakers associated with wide and height channels and surrounds firing as array mode or as discrete individual mode as well as overhead loudspeakers.

DETAILED DESCRIPTION OF EXEMPLARY EMBODIMENTS

Figure 1:
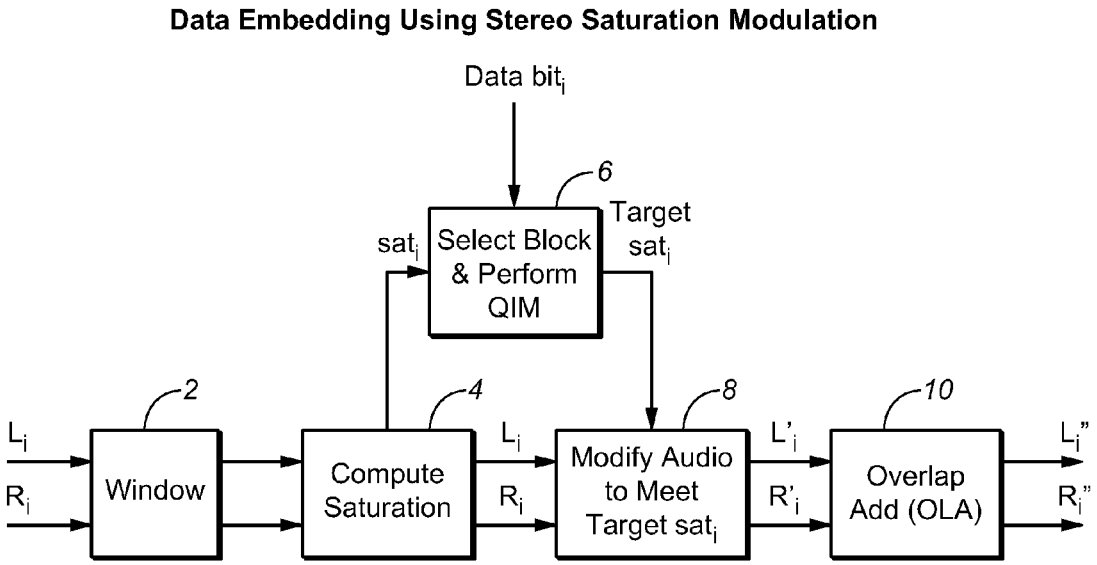
FIG. 1 is a block diagram of an embodiment of a system for performing an embodiment of the inventive data embedding method on a stereo audio signal comprising a sequence of frames.

Many embodiments of the present invention are technologically possible. It will be apparent to those of ordinary skill in the art from the present disclosure how to implement them. Embodiments of the inventive system and method will be described with reference to FIGS. 1-8.

In a class of embodiments, the invention is a method for embedding data (e.g., metadata for use during post-processing) in a stereo audio file comprising a sequence of frames of audio data. Each of the frames has a saturation value, and the data are embedded (e.g., hidden) in the file by modifying the file, thereby determining a modulated stereo audio file comprising a sequence of modulated frames having modulated saturation values indicative of the embedded data. In typical embodiments, quantization index modulation ("QIM") is employed to embed the data.

To perform QIM, the range of possible saturation values (for each frame) is quantized into M steps (segments), each having width $\Delta$ (i.e., having width at least substantially equal to $\Delta$). The "j"th step (where "j" is an index ranging from 0 through M−1) has a representative value, $r_j$ (typically, $r_j$ is the median of the values of the "j"th step). A first target value, equal to $r_j+\Delta_2$, corresponds to a first binary bit of the data to be embedded (e.g., a "1" bit to be embedded), and a second target value, equal to $r_j-\Delta_2$, corresponds to a second binary bit of the data to be embedded (e.g., a "0" bit to be embedded). Typically, $\Delta_2$ is at least substantially equal to $\Delta/4$, and the representative value, $r_j$ of the "j"th step is the median of the values of the step. When the saturation value of a frame of the input audio (the "i"th frame) is within the "j"th quantization step, said saturation value is mapped (preferably in a manner to be described herein) to the first target value (of the "j"th or the "j+1"th quantization step) to indicate a first binary bit of the data to be embedded, or to the second target value (of the "j"th or the "j−1"th quantization step) to indicate a second binary bit of the data to be embedded. The audio data of each frame are then modified (filtered) to generate a modified ("modulated") frame whose saturation value is the target value (i.e., the frame is replaced by a modified frame whose saturation value is the target value).

Typically, the saturation value of each frame of the input stereo audio file is indicative of one of the following three spatial attributes of the frame:

Saturation: a value indicative of relative strength of dominant signal component (i.e., the dominant one of the Left and Right channels) to ambient signal component (i.e., the non-dominant one of the Left and Right channels);

LR saturation: a value indicative of Left-Right balance in the stereo mix; and

SD saturation: a value indicative of Front-Back balance in the stereo mix.

An exemplary embodiment (to be described below) has a data embedding capacity of about 500 bits per second, and is robust against wideband gain change and resampling (although it is susceptible to other modifications).

FIG. 1 is a block diagram of a system for performing an embodiment of the inventive data embedding method on an input stereo audio file comprising a sequence of frames. The "i"th frame of the input audio file comprises a sequence of Left channel audio data samples $L_i$, and a sequence of N Right channel audio data samples $R_i$, as indicated in FIG. 1. The system includes processing stages (subsystems) 2, 4, 6, 8, and 10, as shown. We next describe the processing operations performed in each of stages 2, 4, 6, 8, and 10 to embed a bit ($bit_i$) of binary data in each frame of the input audio.

Stage 2 applies a window to each channel of each frame of the input audio. The Left channel ($L_i$) of the "i"th frame of the input audio comprises N samples, and the Right channel ($R_i$) of the "i"th frame of the input audio comprises N samples. In stage 8 of the FIG. 1 system, each frame of input audio is modified to embed one binary bit (Data $bit_i$) therein. Since the modification of each frame (the "i"th frame) is independent of the modifications of the previous and subsequent ("i+1"th and "i−1"th) frames, the modified stereo data output from stage 8 will exhibit discontinuities across frame boundaries. The window applied in stage 2 is designed to prevent these discontinuities from being audible when the modified audio is rendered.

Figure 2:
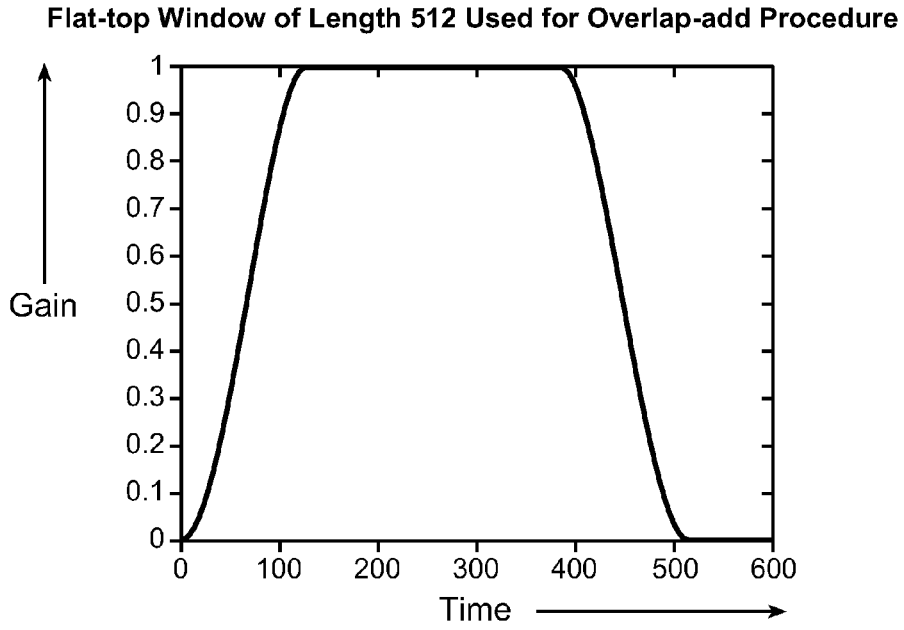
FIG. 2 is a graph of an exemplary filter of the type applied by stage 2 of the FIG. 1 system to an input stereo audio signal.

FIG. 2 is a graph of an example of the filter applied by stage 2 (in the case that the frame length is 512 samples) to each of the R and L channels. FIG. 2 shows the gain applied by stage 2 as a function of time in units of sample period (e.g., unity gain is applied to the "129"th through "383"th samples of each channel of each frame). Each of the tapering parts of this flat-top filter ("window") has form:

$$\text{sine_window}(k)=\sin^2((k\pi/N_{sine})+\phi),$$

where $N_{sine}$=512, k is an index which ranges from 1 to $N_{sine}$ (k=1, 2, . . . , $N_{sine}$), and $\phi$ is a phase offset.

Typically, the frame length (of the input audio processed by the FIG. 1 system) will be 128 samples (rather than 512 samples). For frame length equal to 128 samples, the window applied by stage 2 may be a flat-top filter having shape similar to that shown in FIG. 2 but with a length equal to 128 sample periods (i.e., $N_{sine}$=128).

In processing stage 4, a saturation value is computed from each windowed frame of audio samples. In a typical implementation of stage 4, the saturation value represents the strength of the dominant signal component (the dominant one of the L and R channels) relative to the non-dominant signal component, and has a value between 0 and 1. A saturation value of '1' indicates that all the energy in L and R is from a single dominant signal (no ambience present). A saturation value of '0' indicates that the signal components in L and R are completely uncorrelated. In a typical implementation, the saturation value is computed as follows.

We define the following saturation parameters (for each frame input to stage 4):

$$LR\text{sat}=(E(L^2)-E(R^2))/(E(L^2)+E(R^2))$$

and $$SD\text{sat}=(E(S^2)-E(D^2))/(E(S^2)+E(D^2)),$$

where L denotes the Left channel samples of a frame, R denotes the Right channel samples of the frame, and where S=L+R (i.e., S denotes "Front" samples of the frame, each of which is the sum of one of the Left channel samples of the frame and a corresponding one of the Right channel samples of the frame), D=L−R (i.e., D denotes "Back" samples of the frame, each of which is the difference between one of the Left channel samples of the frame and a corresponding one of the Right channel samples of the frame), and "E" denotes signal energy. Each of the parameters LRsat and SDsat has values in the range [−1,1], with LRsat equal to +1 when all the signal energy is in the left channel ($E(R^2)=0$) and −1 when all the signal energy is in the right channel ($E(L^2)=0$). SDsat is equal to 1 when all the energy is in the front ($E(D^2)=0$) and is equal to −1 when all the energy is in the back ($E(S^2)=0$).

The saturation value ($sat_i$) determined by stage 4 in response to the "i"th windowed frame is then computed as:

$$\text{sat}_i=\text{sqrt}(LR\text{sat}_i^2+SD\text{sat}_i^2),$$

where $LRsat_i$ is the above-defined parameter, LRsat, for the "i"th windowed frame, and $SDsat_i$ is the above-defined parameter, SDsat, for the "i"th windowed frame.

Figure 3:
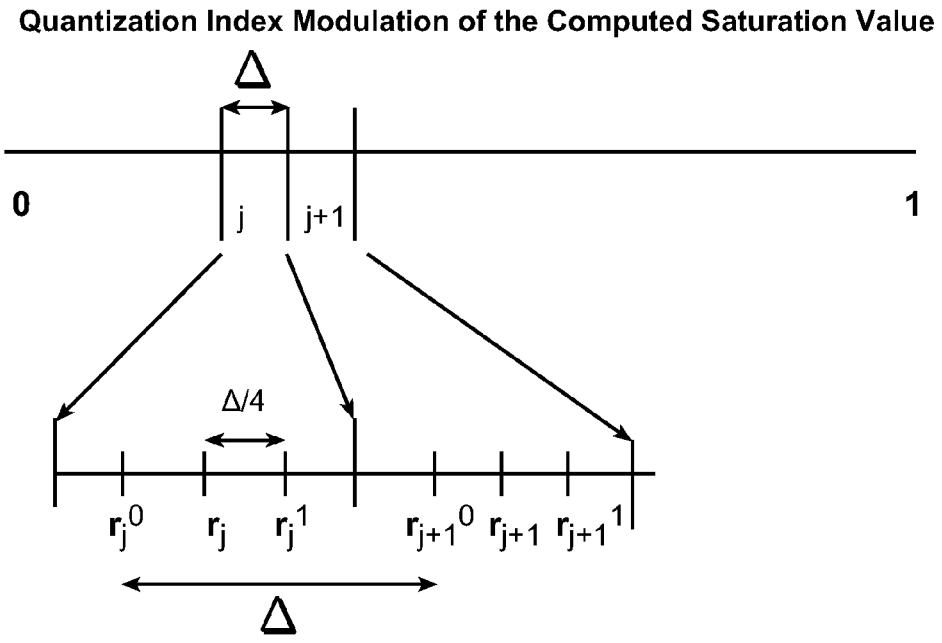
FIG. 3 is a diagram of a saturation values (in a range from 0 to 1), illustrating how saturation values determined by an implementation of stage 4 of the FIG. 1 system are mapped (in an implementation of stage 6 of the FIG. 1 system) to target saturation values.

Stage 6 determines a target saturation value, target $sat_i$, for the "i"th windowed frame in response to the saturation value ($sat_i$) for the frame and the data bit (Data $bit_i$) to be embedded (hidden) in the frame. To do so, the computed saturation value ($sat_i=\text{sqrt}(LRsat_i^2+SDsat_i^2)$, for the frame, whose value is within the range from 0 through 1, is quantized using two uniform quantizers $Q^0$ and $Q^1$ (both with $\Delta$ as step size). The choice of the quantizer ($Q^0$ or $Q^1$) is dependent on the value (0 or 1) of the data bit to be embedded. FIG. 3 shows the possible values of the target saturation value $sat_i$ (identified in FIG. 3 as representation levels $r_j^0$, $r_{j-1}^0$, $r_j^1$, and $r_{j+1}^1$) when the saturation value ($sat_i$) is in the "j"th segment of the quantized saturation value range. The saturation value ($sat_i$) in the "j"th segment of the quantized range is identified in FIG. 3 as "$r_j$."

More specifically, FIG. 3 shows the possible representation levels ($r_j^0$ or) $r_{j-1}^0$) for the quantizer $Q^0$ (corresponding to Data $bit_i$=0) for the saturation value $r_j$, and the possible representation levels ($r_j^1$ or $r_{j+1}^1$) for the quantizer $Q^1$ (corresponding to Data $bit_i$=1) for the saturation value $r_j$.

In the FIG. 3 example, quantization index modulation ("QIM") is employed as follows to determine the target saturation value, target $sat_i$, for embedding the data bit Data bit, in the "i"th frame:

- If Data $bit_i$=0 and $r_j=sat_i$ is less than or equal to $r_j^1$, then saturation value $r_j=sat_i$ is quantized to target $sat_i=r_j-\Delta/4=r_j^0$;
- If Data $bit_i$=0 and $r_j=sat_i$ is greater than $r_j^1$, then saturation value $r_j=sat_i$ is quantized to target $sat_i=r_{j+1}-\Delta/4=r_{j+1}^0$;
- If Data $bit_i$=1 and $r_j=sat_i$ is less than or equal to $r_j^0$, then saturation value $r_j=sat_i$ is quantized to target $sat_i=r_j+\Delta/4=r_j^1$; and
- If Data $bit_i$=1 and $r_j=sat_i$ is greater than $r_j^0$, then saturation value $r_j=sat_i$ is quantized to target $sat_i=r_{j-1}+\Delta/4=r_{j-1}^1$.

Note that the possible representation levels for embedding a zero bit in intervals j and j+1 are $\Delta$ apart (i.e., $abs(r_j^0-r_{j+1}^0)=\Delta$). Similarly, the possible representation levels for embedding a one bit in intervals j and j+1 are $\Delta$ apart (i.e., $abs(r_j^1-r_{j+1}^1)=\Delta$). This implies that the possible representation levels for embedding a zero, and the possible representation levels for embedding a one, represent two staggered quantizers $Q^0$ and $Q^1$ respectively.

Also, it should be noted that quantization index modulation in accordance with FIG. 3 results in determination of a target saturation value which satisfies $abs(sat_i-\text{target } sat_i)<\Delta/2$.

In stage 8 of the FIG. 1 system, the samples $L_i$, $R_i$ of each windowed frame are modified such that the frame's saturation value is changed from the original value ($sat_i$) to the target value (target $sat_i$) determined in stage 6. In a typical implementation of stage 8, the following iterative process achieves the modification.

The process employs a set of values defined as follows: $L_modifier_i=R_i+\text{hilbert}(R_i)$, where $R_i$ are the Right channel samples of the "i"th windowed frame (output from stage 2 and passed through stage 4) and $\text{hilbert}(R_i)$ are transformed Right channel samples generated by performing a Hilbert transform on the samples $R_i$. For the "i"th windowed frame, the values "$L_modifier_i$" consist of N values $L_modifier_{ij}=R_{ij}+\text{hilbert}(R_i)_j$, where N is the number of samples $R_i$ in the frame, and j is an index identifying the "j"th Right channel sample in frame and the "j"th transform value generated by Hilbert transforming the Right channel samples of the frame.

The process also employs a set of values defined as follows: $R_modifier_i=L_i+hilbert(L_i)$, where $L_i$ are the Left channel samples of the "i"th windowed frame (output from stage 2 and passed through stage 4) and $hilbert(L_i)$ are transformed Left channel samples generated by performing a Hilbert transform on the samples $L_i$. For the "i"th windowed frame, the values "$R_modifier_i$" consist of N values $R_modifier_{ij}=L_{ij}+hilbert(L_i)_j$, where N is the number of samples $L_i$ in the frame, and j is an index identifying the "j"th Left channel sample in frame and the "j"th transform value generated by Hilbert transforming the Left channel samples of the frame.

The above-mentioned exemplary iterative process implemented by stage 8 generates a modified frame (comprising modified left channel samples $L'_i$ and modified right channel samples $R'_i$) in response to the "i"th windowed frame (comprising samples $L_i$ and $R_i$), and includes the following steps:

(a) initialize the modified frame samples to match the input frame samples ($L'_i=L_i$ and $R'_i=R_i$);

(b) check whether the saturation value for the modified frame matches the target saturation value, target sat;

(c) if the saturation value for the modified frame does not match the target saturation value, modify the modified frame samples as follows: $L'_i=L'_i+/-g*L_modifier_i$, and $R'_i=R'_i+/-g*R_modifier_i$;

(d) after step (c), repeat step (b) to the check whether the saturation value for the most recently modified frame matches the target saturation value, target $sat_i$; and if it does not match the target saturation value, repeat steps (c) and (d) to further modify the most recently modified frame samples and check whether the saturation value for the most recently modified frame matches the target saturation value, until the saturation value for the most recently modified frame does match the target saturation value.

In step (c), the value "g" is a small gain value, which is chosen so that $L'_i$ and $R'_i$ are modified in sufficiently small steps (in each iteration of step (c)) for the process to converge sufficiently rapidly to produce a modified frame whose saturation value is the target saturation value.

In an alternative to the iterative process described above, stage 8 performs the following non-iterative process. It determines a gain value "g" (as a closed form solution) such that if the input frame samples ($L_i$ and $R_i$) are modified to produce a modified frame whose modified samples satisfy $L'_i=L_i+/-g*L_modifier_i$, and $R'_i=R_i+/-g*R_modifier_i$, the saturation value of the modified frame matches the target saturation value. It then modifies the input frame samples ($L_i$ and $R_i$) to produce the modified frame.

The samples of each modified frame (the "i"th modified frame) determined in stage 8 (comprising right channel samples $R'_i$ and left channel samples $L'_i$) are overlap added in stage 10 to the samples of the previous modified frame (the "i−1"th modified frame, which comprises right channel samples $R'_{i-1}$ and left channel samples $L'_{i-1}$), to generate an output modified frame comprising modified right channel samples $R''_i$ and modified left channel samples $L''_i$). For instance, in one implementation of stage 10, in the case that the modified frame length is N=512, stage 10 adds the first 64 samples of $L'_i$ to the last 64 samples of $L'_{i-1}$, and adds the first 64 samples of $R'_i$ to the last 64 samples of $R'_{i-1}$.

In another alternative implementation of the FIG. 1 system, stage 4 determines a saturation value for each frame which is not the above-defined value $sat_i=sqrt(LRsat_i^2+SDsat_i^2)$, and is instead a spatial attribute of another type (e.g., the above-defined value SDsat, which represents front-back balance). In the case that each saturation value determined by stage 4 is the above-defined value SDsat, stage 6 determines a target saturation value, target $sat_i$, for the "i"th windowed frame in response to the saturation value determined in stage 4 for the frame and the data bit (Data $bit_i$) to be embedded (hidden) in the frame, and stage 8 modifies the "i"th windowed frame so that its saturation value matches the target saturation value.

Unlike the above-defined value $sat_i=sqrt(LRsat_i^2+SDsat_i^2)$, SDsat is a number in the range from −1 to +1 (with the value −1 indicating that all the signal energy is in the back and the value +1 indicating that all the signal energy is in the front). SDsat can be computed from the following equation:

$$SDsat = (E(S^2) - E(D^2))/(E(S^2) + E(D^2)) = 2E(LR)/E(L^2) + E(R^2)). \quad (1)$$

In equation (1), L denotes the Left channel samples of a frame, R denotes the Right channel samples of the frame, S=L+R (i.e., S denotes "Front" samples of the frame, each of which is the sum of one of the Left channel samples of the frame and a corresponding one of the Right channel samples of the frame), D=L−R (i.e., D denotes "Back" samples of the frame, each of which is the difference between one of the Left channel samples of the frame and a corresponding one of the Right channel samples of the frame), and "E(x)" denotes energy of signal x.

Let us assume that stage 8 of the FIG. 1 system modifies the Left and Right channel samples (L and R) of a frame to produce a modified frame whose samples (L' and R', having values as given in equations (2) and (3) below) achieve a target saturation value which is a target value of SDsat. For simplicity, we drop the suffix 'i' indicating the frame i:

$$L'=L+g(R+R_h); \quad (2)$$

and $$R'=R+g(L+L_h). \quad (3)$$

In equations (2) and (3), $R_h$ and $L_h$ are Hilbert transforms of the Right channel samples (R) of the frame and of the Left channel samples (L) of the frame, respectively. If the target SDsat value is represented as "target_sd_sat," then $$target_sd_sat=2E(L'R')/E(L'^2)+E(R'^2). \quad (4)$$

Substituting equations (2) and (3) into equation (4) gives $$\begin{aligned} target_sd_sat(E(L'^2) + E(R'^2)) &= 2E((L + g(R + R_h))(R + g(L + L_h))) = \\ &2E(LR) + 2gE(L(L + L_h)) + \\ &2gE(R(R + R_h)) + 2g^2E((R + R_h)(L + L_h)) = \\ &target_sd_sat(E(L + g(R + R_h))^2) + E(R + g(L + L_h))^2)) = \\ &target_sd_sat(E(L^2) + g^2E((R + R_h)^2) + 2gE(L(R + R_h)) + \\ &E(R^2) + g^2E((L + L_h)^2) + 2gE(R(L + L_h)). \end{aligned} \quad (5)$$

Rearranging the left and right sides of equation (5) determines an equation of the following quadratic form to solve for g:

$$ag^2+bg+c=0$$

where $$a=target_sd_sat(E((R+R_h)^2)+E((L+L_h)^2))-2E((R+R_h)(L+L_h));$$

$$b=\text{target_}sd\text{_sat}(2E(L(R+R_h))+2E(R(L+L_h)))-2E(L(L+L_h))-2E(R(R+R_h));$$

and $$c=\text{target_}sd\text{_sat}(E(L^2)+E(R^2))-2E(LR).$$

Thus, $$g=(-b+\text{sqrt}(b^2-4ac))/2a \text{ and } g=(-b-\text{sqrt}(b^2-4ac))/2a,$$

where "sqrt(x)" denotes the square root of x.

Empirically, we have found that a ~0, which implies that a value of g suitable for use in stage 8 to modify the frame is simply solved in closed form as $$g=-c/b.$$

Similarly, a value of g can be determined in closed form for use in stage 8 to modify a frame (having above-defined saturation value LRsat) such that its modified saturation value matches a target saturation value (target_lr_sat value).

Figure 4:
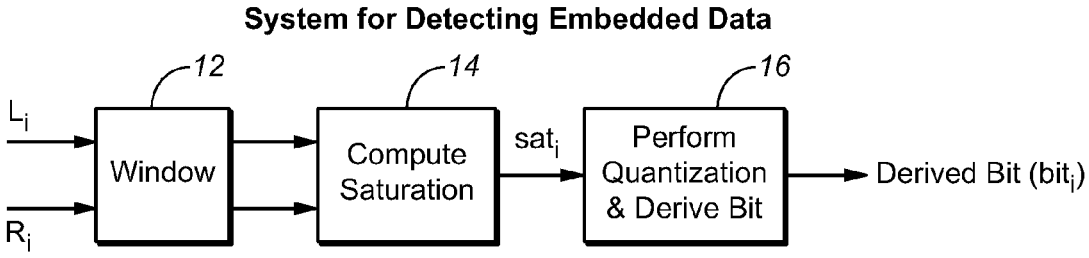
FIG. 4 is a block diagram of an embodiment of a system for extracting from a stereo audio signal (in which data have been embedded in accordance with an embodiment of the invention) the data which have been embedded in the signal in accordance with the invention.

With reference to FIG. 4, we next describe an embodiment of a system for extracting data from a stereo audio signal (in which the data have been embedded in accordance with an embodiment of the invention).

The data extracting system ("detector") of FIG. 4 assumes that the modified Left channel (input signal $L_i$ in FIG. 4) and modified Right channel (input signal $R_i$ in FIG. 4) to be processed in the detector are in synchronization with the embedder (e.g., the FIG. 1 system) in the sense that the frame boundaries in the embedder's output are the same as the frame boundaries in the detector's input. If this assumption cannot be made (e.g., if the frame boundaries in the embedder's output are not the same as the frame boundaries in the detector's input), the detector should include an initial synchronization stage (not shown in FIG. 4) for performing preliminary synchronization on the detector's input signal (before the remaining portion of the detector extracts the embedded data from the synchronized input signal).

The FIG. 4 system includes processing stages (subsystems) 12, 14, and 16, as shown. We next describe the processing operations performed in each of stages 12, 14, and 16 to extract an embedded bit ($bit_i$) of binary data from each frame (the "i"th frame) of the input stereo audio signal.

Stage 12 applies a window to each channel of each frame of the input audio. The Left channel ($L_i$) of the "i"th frame of the input audio comprises N samples, and the Right channel ($R_i$) of the "i"th frame of the input audio comprises N samples. In the data embedding system, each frame of the input audio has been modified to embed one binary bit therein. Since the modification of the saturation value of each frame (the "i"th frame) is independent of the modifications of the previous and subsequent ("i+1"th and "i−1"th) frames, the input audio (asserted to the input of stage 12) may have saturation value discontinuities across frame boundaries. The applied window in stage 12 is designed to prevent these discontinuities from being audible when the audio is rendered. If the data embedding system had applied a window (e.g., the window applied in stage 2 of the FIG. 1 system) to the stereo audio in which it embedded the data (before determining a saturation value of each frame of the stereo audio), the window applied in stage 12 of the detector is preferably the same window as was applied in the data embedding system.

Processing stage 14 of the FIG. 4 system determines a saturation value ("$sat_i$") from each windowed frame of stereo audio data output from stage 12, preferably in the same manner as the data embedding system (e.g., stage 4 of the FIG. 1 system) determined the saturation value of each stereo audio frame in which the embedding system embedded a bit of data.

Each saturation value (sat) determined in stage 14 from one of the windowed frames (the "i"th frame) of stereo audio data is processed in stage 16 to determine the binary data bit ($bit_i$) that is embedded in the frame. In a typical implementation of stage 16 (for extracting data bits that have been embedded using a Quantization Index Modulation method of the type described above with reference to FIG. 3), for each frame of stereo audio, stage 16 finds the representation level (among representation levels of the two quantizers $Q^0$ and $Q^1$ employed during the data embedding) that is closest to the saturation value ($sat_i$) determined in stage 14 for the frame. If the closest representation level belongs to quantizer $Q^0$, then the embedded bit is decoded as a 0 bit; otherwise it is decoded as a 1 bit. More specifically, in a typical implementation of stages 14 and 16, the saturation value ($sat_i$) determined in stage 14 for a frame is a value $r_i$ (in one of the quantized segments, shown in FIG. 3, of the full range of possible values of the saturation value). Quantized representation levels $r_j^0$ and $r_j^1$ (for all values of the quantization index, j) are stored in, or accessible to, stage 16. If stage 16 determines that the closest one (to saturation value $r_i$) of the quantized representation levels $r_j^0$ and $r_j^1$ is one of the quantized levels $r_j^0$ (having any value of j), then stage 16 identifies the embedded bit for the frame to be a zero bit ($bit_i$=0). If stage 16 determines that the closest one (to saturation value $r_i$) of the quantized representation levels $r_j^0$ and $r_j^1$ is one of the quantized levels $r_j^1$ (having any value of j), then stage 16 identifies the embedded bit for the frame to be a one bit ($bit_i$=1).

Parameters of typical embodiments of the inventive embedding method and system are described below. The embodiments are also characterized in terms of audibility (of the audio data modulations implemented to embed data), robustness, and hiding capacity (embedded bit rate).

A typical embodiment of the inventive data embedding method and system has the following the parameter values:

frame length equal to 128 samples at 48 kHz (128 samples per frame, with processing at a rate of 48,000 samples per second), and window size (the flat top portion of the windowing filter applied by stage 2 of the FIG. 1 system) equal to 0.75*128 samples=96 samples. This implies that there will be about 5000 frames in 10 seconds of stereo audio at 48 kHz. If one data bit is embedded in each frame, the embodiment has a data embedding (hiding) capacity of about 500 bits per second (500 bps);

frame samples are downsampled to 8 kHz before computing the saturation value for each frame of the input audio. This provides robustness against sample rate conversion; and the quantization step size Δ (of each of the quantizers $Q^0$ and $Q^1$) is chosen to be 0.01 (i.e., there are one hundred quantization steps in the saturation value range from 0 to 1).

It has been determined that the following three factors are important to achieve good quality of the audio in which data have been embedded in accordance with the invention.

It has been determined that the quantization step size Δ (of each of the quantizers $Q^0$ and $Q^1$) should be 0.01 or less, assuming that the saturation value has a range from 0 to 1, in order for the audio data modification to be inaudible.

It has also been determined that an overlap adding process (in stage 10 of the FIG. 1 system) with a 75% flat-top window as in FIG. 2 helps to mask the discontinuities (in saturation value) introduced into the audio across frame boundaries.

Also, it has been determined that data should not be embedded in regions (segments) of an input stereo signal for which the saturation value is already either too high (e.g., greater than 0.98) or too low (e.g., less than 0.02). The signal selection needed to implement this should be done in a way that is same in the embedded data extractor and the data embedder.

A test signal whose Left channel is a 400 Hz audio signal and whose Right channel is a 400.1 Hz audio signal, has been used in tests of the invention. The stereo test signal included about 5000 frames of audio data. Each frame had a saturation value, $sat_i$=sqrt($LRsat_i^2$+$SDsat_i^2$), as defined above, and the saturation values (as a function of frame index) swept the whole range from 0 to 1.

A system of the type described with reference to FIG. 1 (implemented in software) was employed to embed binary data in the test signal, by modulating the saturation values ($sat_i$=sqrt($LRsat_i^2$+$SDsat_i^2$)) of frames of the test signal. Data was not embedded in the first 40 frames of the test signal, since the saturation values of these frames were greater than 0.98.

Figure 5:
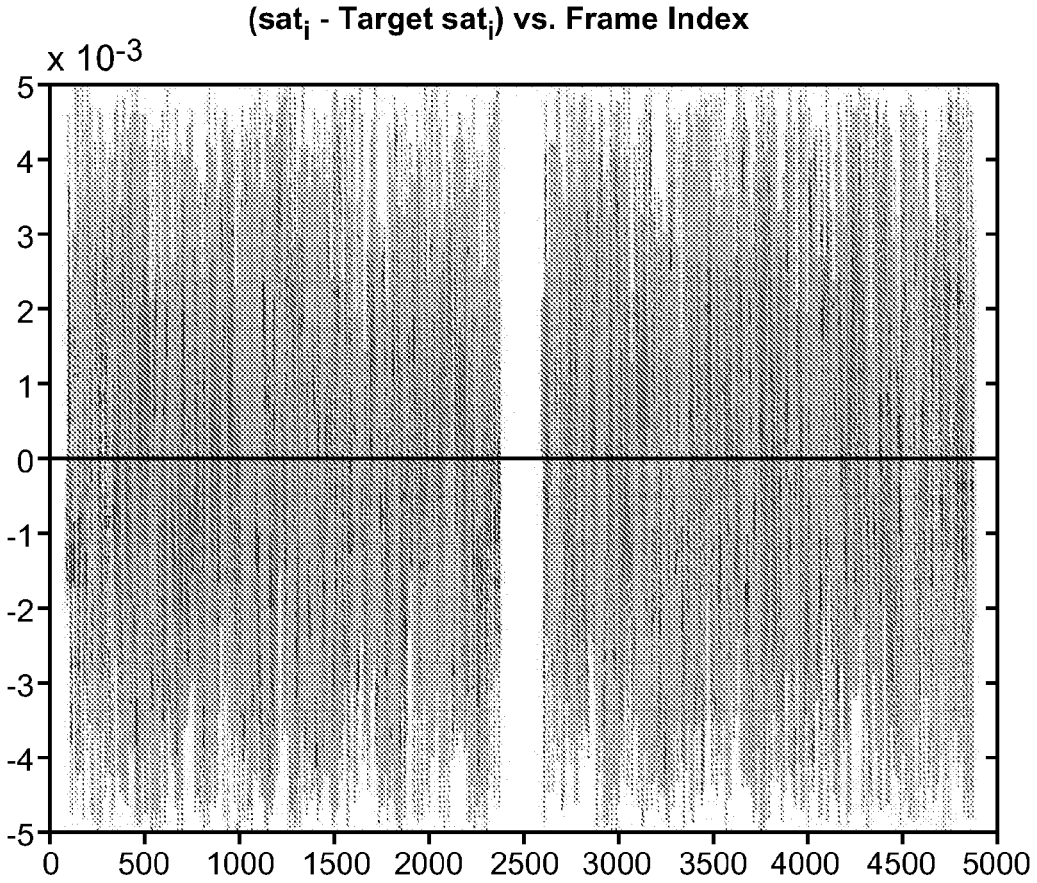
FIG. 5 is a graph of the difference between the saturation value of each of a number of frames of a test signal and the target saturation value generated (in accordance with an embodiment of the invention) in order to embed data in these frames.

FIG. 5 is a graph of the difference between the saturation value (of each of a number of frames of the test signal, not including frames 1-40) and the target saturation value generated (by stage 6 of the system) in order to embed data in these frames. FIG. 5 shows that the absolute value of each of the graphed differences, abs($sat_i$−target $sat_i$) is less than $5*10^{-3}$, which is equal to Δ/2 since Δ of the quantizer is chosen to be 0.01 (there are one hundred quantization steps in the range, from 0 to 1, of the saturation values).

In order to understand the robustness of an embodiment of the inventive method, 75 stereo audio signal excerpts were generated, each having length of about 10 seconds and comprising about 5000 frames of audio data, with data embedded in each in accordance with an embodiment of the invention. Each of the excerpts was subjected to the following attacks: (1) AAC stereo coding and decoding at 192 kbps; (2) mp3 coding at 192 kbps; (3) Dolby volume processing (to increase and to decrease perceived loudness levels using multiband processing); (4) wideband gain change; and (5) 6 kHz downsampling and upsampling. After these attacks, the percentage of the embedded bits that were correctly detected was measured. It was determined that the tested embodiment of the inventive method is robust to wideband gain change and resampling attacks.

In typical embodiments, the inventive data embedding method achieves a very high embedding capacity (e.g., about 500 bps) based on modulation of a stereo saturation value. Typically, the modulation is performed using QIM to determine target saturation values (indicative of the data to be embedded) and the modification to the input stereo signal is achieved by an iterative process (in which the iteration ends when the saturation value of the signal frame being modified matches the corresponding target saturation value). The data embedding method is robust to wideband gain change and sample rate conversion, although it may not be robust to audio coding or other processing which disturbs the relationship between the Left and Right channels of the modified stereo signal.

Typical embodiments of the inventive data embedding method are useful to convey metadata from a decoder to a post-processor (e.g., a post-processor in the same product as the decoder). The post-processor (or the decoder and post-processor) may be a set-top box, a computer operating system (e.g., a Windows OS or Android OS), or a system or device of another type. Using the metadata which have been embedded in accordance with the invention, the post-processor can adapt accordingly. For example, metadata may be embedded in a stereo audio signal (in accordance with the invention) periodically (e.g., once per second), and the metadata may be indicative of the type of audio content (e.g., voice or music) of the stereo audio signal, and/or the metadata may be indicative of whether upmixing or loudness processing has been performed on the stereo audio signal.

The invention may be implemented in software (e.g., in an encoder or a decoder that is implemented in software), or in hardware or firmware (e.g., in a digital signal processor implemented as an integrated circuit or chip set).

Figure 7:
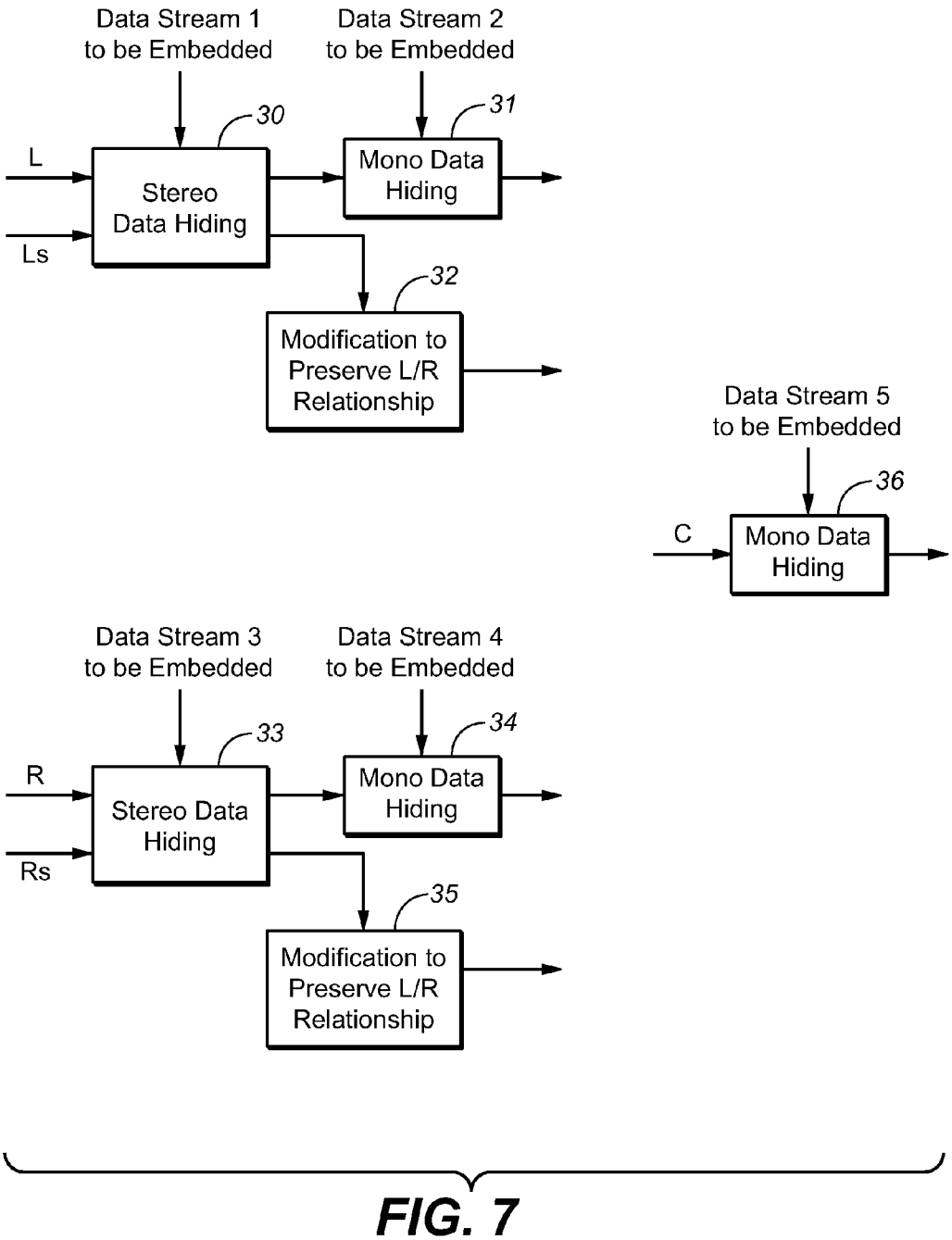
FIG. 7 is a block diagram of a system for performing an embodiment of the inventive data embedding method on two channels (Left and Left Surround channels) of a five-channel audio signal to embed a data stream therein, and for embedding a second data stream in one of these channels (the Left channel), and for performing an embodiment of the inventive data embedding method on two other channels (Right and Right Surround channels) of the signal to embed a third data stream therein, and for embedding a fourth data stream in one of these other channels (the Right channel), and for embedding a fifth data stream in a fifth channel (the Center channel) of the signal.
Figure 8:
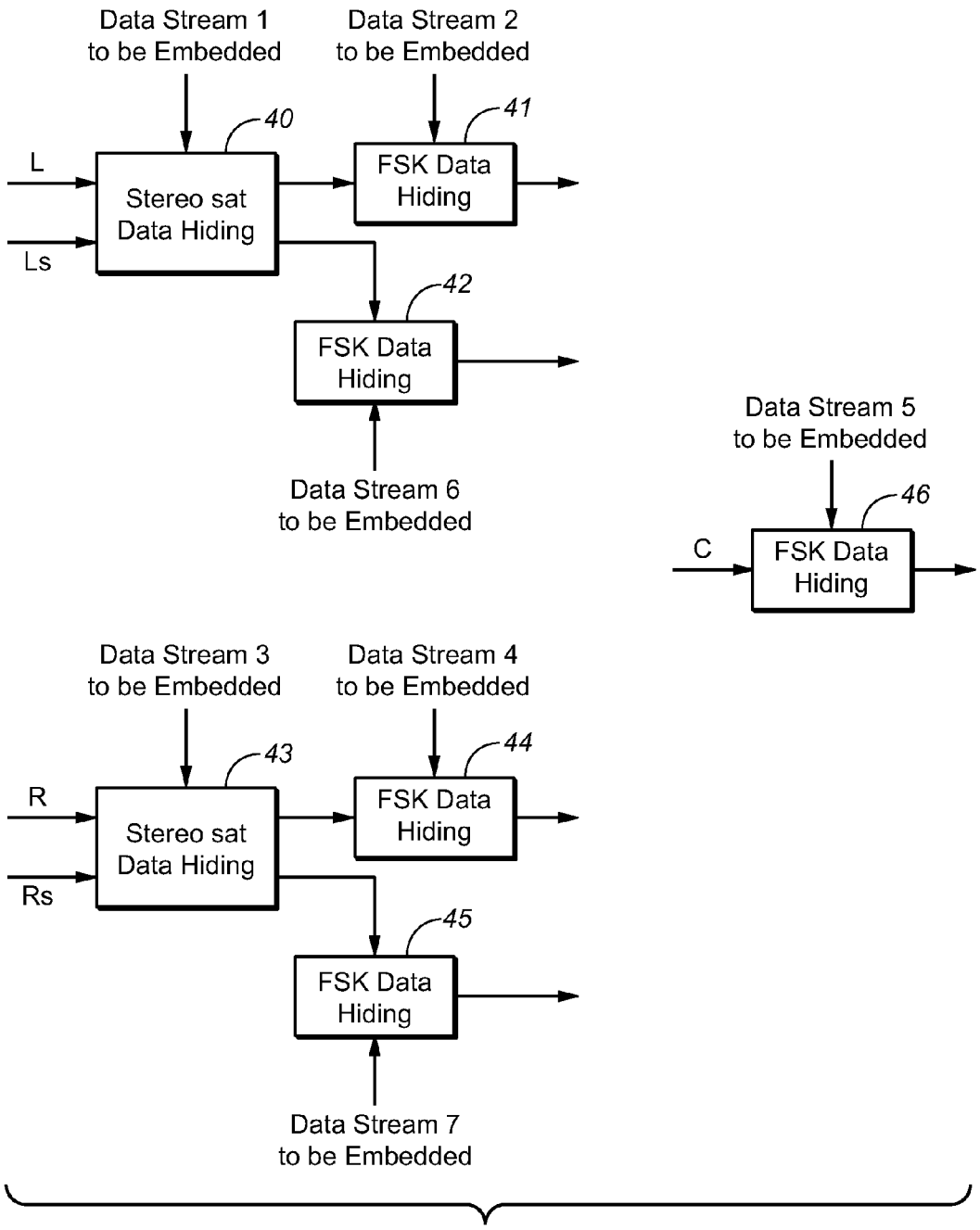
FIG. 8 is a block diagram of a system for performing an embodiment of the inventive data embedding method on two channels (Left and Left Surround channels) of a five-channel audio signal to embed a data stream therein, and for embedding a second data stream in the Left channel and a third data stream in the Left Surround channel, and for performing an embodiment of the inventive data embedding method on two other channels (Right and Right Surround channels) of the signal to embed a fourth data stream therein, and for embedding a fifth data stream in the Right channel, a sixth data stream in the Left Surround channel, and a seventh data stream in a fifth channel (the Center channel) of the signal.

In some embodiments, the inventive method for embedding (e.g., hiding) data in stereo audio is combined with at least one monophonic data hiding method to achieve increased data embedding capacity. For example, each of FIGS. 7 and 8 are a block diagram of a system configured to perform such an embodiment of the inventive method on a multi-channel audio signal comprising frames. In the system of each of FIGS. 7 and 8, a modified stereo audio signal comprising modified frames is generated in response to two channels of the input audio signal, and a data stream is embedded in at least a subset of the modified frames, and an additional data stream is embedded in one of the channels (e.g., the Left channel in FIG. 6) of the modified stereo audio signal.

Figure 6:
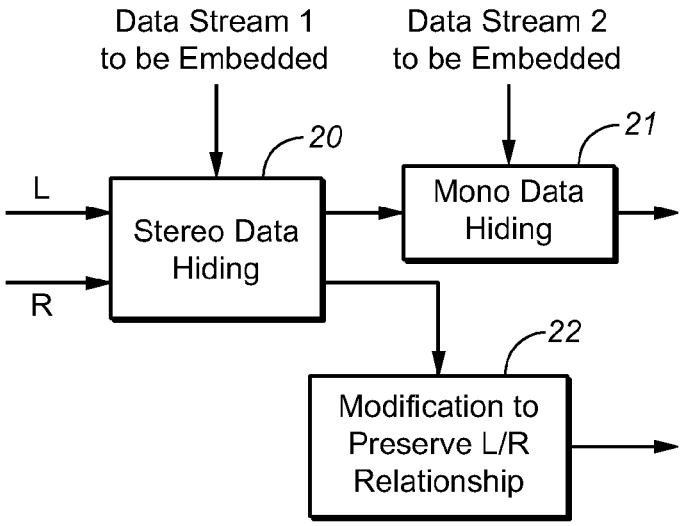
FIG. 6 is a block diagram of a system for performing an embodiment of the inventive data embedding method on a stereo audio signal comprising frames, to generate a modified stereo audio signal comprising modified frames, wherein a data stream is embedded in in at least a subset of the modified frames, and also to embed a second data stream in one of the channels (the Left channel) of the modified stereo audio signal.

Stage 20 of the FIG. 6 system is coupled and configured to embed a first data stream in the stereo audio signal in accordance with the invention (e.g., in accordance with the embodiment described above with reference to FIG. 1), thereby generating a modified stereo signal having modified saturation values indicative of the first data stream. The left channel of the modified stereo signal is asserted to stage 21 of the FIG. 6 system and the right channel of the modified stereo signal is asserted to stage 22 of the FIG. 6 system. Stage 21 is coupled and configured to embed a second data stream ("Data stream 2") in the left channel of the modified stereo signal (e.g., using a frequency-shift key or "FSK" method). Stage 22 is coupled and configured to further modify the right channel of the modified stereo signal to ensure that the final stereo signal (in which both data streams have been embedded) output from stages 21 and 22 has the same saturation values as does the modified stereo signal (in which only the first data stream has been embedded) output from stage 20.

One example of a method implemented by stage 21 for embedding the second data stream is an FSK method in which one of the following operations is performed on each frame of one channel of the modified stereo signal:

applying (to each frame of the input to stage 21) a notch filter centered at a first frequency (e.g., 15.1 kHz) and adding (to the resulting notch-filtered signal) a sinusoidal signal whose frequency is the first frequency and whose amplitude is the average amplitude of the samples of the frame (or the average amplitude of the samples of the frame in a narrow frequency band centered at the first frequency) to embed a first binary bit (e.g., a "zero" bit) of the second data stream in the frame; or applying (to each frame of the input to stage 21) a notch filter centered at a second frequency (e.g., 15.2 kHz) and adding (to the resulting notch-filtered signal) a sinusoidal signal whose frequency is the second frequency and whose amplitude is the average amplitude of the samples of the frame (or the average amplitude of the samples of the frame in a narrow frequency band centered at the second frequency) to embed a second binary bit (e.g., a "one" bit) of the second data stream in the frame.

Stage 30 of the system of FIG. 7 is coupled and configured to perform an embodiment of the inventive data embedding method (e.g., the embodiment described above with reference to FIG. 1) on two channels (Left and Left Surround channels) of a five-channel audio signal to embed a first data stream therein, thereby generating a modified stereo signal having modified saturation values indicative of the first data stream. The left channel of the modified stereo signal is asserted to stage 31 of the FIG. 7 system and the left surround channel of the modified stereo signal is asserted to stage 32 of the FIG. 7 system. Stage 31 is coupled and configured to embed a second data stream ("Data stream 2") in the left channel of the modified stereo signal (e.g., using a frequency-shift key or "FSK" method). Stage 32 is coupled and configured to further modify the left surround channel of the modified stereo signal to ensure that the final stereo signal output from stages 31 and 32 (the two channels output from stages 31 and 32, in which both data streams have been embedded) has the same saturation values as does the modified stereo signal (in which only the first data stream has been embedded) output from stage 30.

Stage 33 of the system of FIG. 7 is coupled and configured to perform an embodiment of the inventive data embedding method (e.g., the embodiment described above with reference to FIG. 1) on two channels (Right and Right Surround channels) of the five-channel audio signal to embed a third data stream ("Data stream 3") therein, thereby generating a modified stereo signal having modified saturation values indicative of the third data stream. The right channel of the modified stereo signal is asserted to stage 34 of the FIG. 7 system and the right surround channel of the modified stereo signal is asserted to stage 35 of the FIG. 7 system. Stage 34 is coupled and configured to embed a fourth data stream ("Data stream 4") in the right channel of the modified stereo signal (e.g., using a frequency-shift key or "FSK" method). Stage 35 is coupled and configured to further modify the right surround channel of the modified stereo signal to ensure that the final stereo signal output from stages 34 and 35 (the two channels output from stages 34 and 35, in which both the third and the fourth data streams have been embedded) has the same saturation values as does the modified stereo signal (in which only the third data stream has been embedded) output from stage 33.

Stage 36 of the FIG. 7 system is coupled and configured to embed a fifth data stream ("Data stream 5") in the center channel of the input five-channel audio signal (e.g., using a frequency-shift key or "FSK" method).

Thus, the FIG. 7 system is coupled and configured to embed five data streams into the five-channel audio signal asserted to the inputs of stages 30, 33, and 36 of the FIG. 7 system.

One example of a method implemented by stage 31 (or stage 34 or stage 36) of the FIG. 7 system for embedding a data stream is an FSK method in which one of the following operations is performed on each frame of one channel of the modified stereo signal:

applying (to each frame of the input to stage 31 or 34 or 36) a notch filter centered at a first frequency (e.g., 15.1 kHz) and adding (to the resulting notch-filtered signal) a sinusoidal signal whose frequency is the first frequency and whose amplitude is the average amplitude of the samples of the frame (or the average amplitude of the samples of the frame in a narrow frequency band centered at the first frequency) to embed a first binary bit (e.g., a "zero" bit) of the data stream in the frame; or applying (to each frame of the input to stage 31 or 34 or 36) a notch filter centered at a second frequency (e.g., 15.2 kHz) and adding (to the resulting notch-filtered signal) a sinusoidal signal whose frequency is the second frequency and whose amplitude is the average amplitude of the samples of the frame (or the average amplitude of the samples of the frame in a narrow frequency band centered at the second frequency) to embed a second binary bit (e.g., a "one" bit) of the data stream in the frame.

Stage 40 of the system of FIG. 8 is coupled and configured to perform an embodiment of the inventive data embedding method (e.g., the embodiment described above with reference to FIG. 1) on two channels (Left and Left Surround channels) of a five-channel audio signal to embed a first data stream therein, thereby generating a modified stereo signal having modified saturation values indicative of the first data stream. The left channel of the modified stereo signal is asserted to stage 41 of the FIG. 8 system and the left surround channel of the modified stereo signal is asserted to stage 42 of the FIG. 8 system. Stage 41 is coupled and configured to embed a second data stream ("Data stream 2") in the left channel of the modified stereo signal (e.g., using a frequency-shift key or "FSK" method), and stage 42 is coupled and configured to embed a third data stream ("Data stream 6") in the left surround channel of the modified stereo signal (e.g., using a frequency-shift key or "FSK" method).

Stage 43 of the system of FIG. 8 is coupled and configured to perform an embodiment of the inventive data embedding method (e.g., the embodiment described above with reference to FIG. 1) on two other channels (Right and Right Surround channels) of the five-channel audio signal to embed a fourth data stream ("Data stream 3") therein, thereby generating a modified stereo signal having modified saturation values indicative of the fourth data stream. The right channel of the modified stereo signal is asserted to stage 44 of the FIG. 8 system and the right surround channel of the modified stereo signal is asserted to stage 45 of the FIG. 8 system. Stage 44 is coupled and configured to embed a fifth data stream ("Data stream 4") in the right channel of the modified stereo signal (e.g., using a frequency-shift key or "FSK" method), and stage 45 is coupled and configured to embed a sixth data stream ("Data stream 7") in the right surround channel of the modified stereo signal (e.g., using a frequency-shift key or "FSK" method).

Stage 46 of the FIG. 8 system is coupled and configured to embed a seventh data stream ("Data stream 5") in the center channel of the input five-channel audio signal (e.g., using a frequency-shift key or "FSK" method).

Thus, the FIG. 8 system is coupled and configured to embed seven data streams into the five-channel audio signal asserted to the inputs of stages 40, 43, and 46 of the FIG. 7 system.

One example of a method implemented by stage 41 (or stage 42 or stage 44 or stage 45 or stage 46) of the FIG. 8 system for embedding a data stream is an FSK method in which one of the following operations is performed on each frame of one channel of the modified stereo signal:

applying (to each frame of the input to stage 41 or 42 or 44 or 45 or 46) a notch filter centered at a first frequency (e.g., 15.1 kHz) and adding (to the resulting notch-filtered signal) a sinusoidal signal whose frequency is the first frequency and whose amplitude is the average amplitude of the samples of the frame (or the average amplitude of the samples of the frame in a narrow frequency band centered at the first frequency) to embed a first binary bit (e.g., a "zero" bit) of the data stream in the frame; or applying (to each frame of the input to stage 41 or 42 or 44 or 45 or 46) a notch filter centered at a second frequency (e.g., 15.2 kHz) and adding (to the resulting notch-filtered signal) a sinusoidal signal whose frequency is the second frequency and whose amplitude is the average amplitude of the samples of the frame (or the average amplitude of the samples of the frame in a narrow frequency band centered at the second frequency) to embed a second binary bit (e.g., a "one" bit) of the data stream in the frame.

Aspects of the invention include a system configured (e.g., programmed) to perform any embodiment of the inventive method, and a computer readable medium (e.g., a disc) which stores code for implementing any embodiment of the inventive method. The invention may be implemented in software (e.g., in an audio signal encoder or an audio signal decoder that is implemented in software), or in hardware or firmware (e.g., in a digital signal processor implemented as an integrated circuit or chip set).

In typical embodiments, the inventive system is or includes a general or special purpose processor programmed with software (or firmware) and/or otherwise configured to perform an embodiment of the inventive method (e.g., so as to implement elements 2, 4, 6, 8, and 10 of FIG. 1, and/or elements 12, 14, and 16 of FIG. 4). In some embodiments, the inventive system is a general purpose processor or a digital signal processor or an audio signal decoder (e.g., implementing elements 2, 4, 6, 8, and 10 of FIG. 1), coupled and configured (e.g., programmed) to generate a modulated audio output signal (e.g., the stereo audio signal output from element 10 of FIG. 1) in response to an input stereo audio signal (e.g., the stereo audio signal input to element 2 of FIG. 1) by performing an embodiment of the inventive embedding method. In some embodiments, the inventive system is a processor (e.g., a general purpose processor or digital signal processor) or an audio signal decoder or post-processor (which may implement elements 12, 14, and 16 of FIG. 4), coupled and configured (e.g., programmed) to extract embedded data (e.g., the data output from element 16 of FIG. 4) from an input stereo audio signal (e.g., the stereo audio signal input to element 12 of FIG. 4), where the data have been embedded in the input stereo audio signal in accordance with an embodiment of the inventive embedding method.

In some embodiments of the inventive method, some or all of the steps described herein are performed in a different order (or simultaneously) than specified in the examples described herein. Although steps are performed in a particular order in some embodiments of the inventive method, some steps may be performed simultaneously or in a different order in other embodiments.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for embedding data in a stereo audio signal comprising a sequence of frames, said method comprising:

modifying the stereo audio signal to generate a modulated stereo audio signal comprising a sequence of modulated frames having modulated saturation values indicative of the data; and embedding one data bit in each frame of the stereo audio signal by modifying said frame to produce a modulated frame whose modulated saturation value matches a target value indicative of the data bit, wherein the modification of each said frame includes steps of applying a gain to a first modification signal to produce a first scaled signal, adding the first scaled signal to a first channel signal indicative of a first channel of the frame to determine a first channel of the modulated frame, applying the gain to a second modification signal to produce a second scaled signal, and adding the second scaled signal to a second channel signal indicative of a second channel of the frame to determine a second channel of the modulated frame.

2. The method of claim 1, wherein the first modification signal is a sum of the second channel signal and the Hilbert transform of the second channel signal, and the second modification signal is a sum of the first channel signal and the Hilbert transform of the first channel signal.

3. The method of claim 1, wherein the gain is determined using an iterative algorithm, whereby the step of modifying the frame is an iterative process.

4. The method of claim 1, wherein the gain is determined in closed form, and the step of modifying the frame is a non-iterative process.

5. The method of claim 1, wherein the modulated saturation values are indicative of a first data stream, and said method also includes a step of:

embedding a second data stream in one of the channels of the modulated stereo audio signal.

6. The method of claim 1, wherein the modulated saturation values are indicative of a first data stream, and said method also includes a step of:

embedding a second data stream in one of the channels of the modulated stereo audio signal including by performing frequency-shift key modulation on said one of the channels of the modulated stereo audio signal.

7. A system configured to extract data embedded in a stereo audio signal, wherein the data was embedded by the method of claim 1.

8. A system configured to embed data in a stereo audio signal comprising a sequence of frames, said system including:

a first processing subsystem configured to determine a saturation value of each of the frames; and a second processing subsystem coupled to the first processing subsystem and configured to modify the stereo audio signal to generate a modulated stereo audio signal comprising a sequence of modulated frames having modulated saturation values indicative of the data, wherein the second processing subsystem is configured to apply a gain to a first modification signal to produce a first scaled signal, add the first scaled signal to a first channel signal indicative of a first channel of the frame to determine a first channel of the modulated frame, apply the gain to a second modification signal to produce a second scaled signal, and add the second scaled signal to a second channel signal indicative of a second channel of the frame to determine a second channel of the modulated frame.

9. The system of claim 8, wherein the second processing subsystem is configured to embed one data bit in each of the frames by modifying said each of the frames to produce a modulated frame having a modulated saturation value which matches a target value indicative of the data bit.

10. The system of claim 8, wherein the frames have a range of possible saturation values, the range is quantized into segments, each of the segments has a width, $\Delta$, a first set of quantized saturation values includes a first quantized value in each of the segments, and a second set of quantized saturation values includes a second quantized value in each of the segments, and the second processing subsystem is configured to:

embed a binary bit of a first type in at least one of the frames by modifying said at least one of the frames to generate a modulated frame having a modulated saturation value, such that the modulated saturation value matches one said first quantized saturation value; and embed a binary bit of a second type in at least one of the frames by modifying said at least one of the frames to generate a modulated frame having a modulated saturation value, such that the modulated saturation value matches one said second quantized saturation value.

11. The system of claim 10, wherein the range of possible saturation values is quantized into M segments, each including a representative value, $r_j$, and having the width $\Delta$, where M is an integer greater than one and "j" is an index ranging from 0 through M−1, the first quantized value in each of the segments is equal to $r_j+\Delta_2$, and the second quantized value in each of the segments is equal to $r_j-\Delta_2$, where $\Delta_2$ is less than $\Delta$.

12. The system of claim 11, wherein $\Delta_2$ is at least substantially equal to $\Delta/4$.

13. The system of claim 12, wherein the representative value, $r_j$, of the "j"th segment is the median of the saturation values in the "j"th segment.

14. The system of claim 10, wherein each said modulated saturation value is indicative of strength of a dominant one of the channels of one of the modulated frames relative to strength of a non-dominant one of the channels of said one of the modulated frames.

15. The system of claim 10, wherein each said modulated saturation value is indicative of Left-Right balance of one of the modulated frames.

16. The system of claim 10, wherein each said modulated saturation value is indicative of Front-Back balance of one of the modulated frames.

17. The system of claim 10, also including a windowing subsystem coupled to the first processing subsystem and configured to apply a window to each channel of each frame of an input stereo audio signal to generate the stereo audio signal, such that each of the frames of said stereo audio signal is a windowed frame.

18. The system of claim 10, wherein the second processing subsystem is configured to embed one data bit in each frame of the stereo audio signal by modifying said frame to produce a modulated frame whose modulated saturation value matches a target value indicative of the data bit, including by applying a gain to a first modification signal to produce a first scaled signal, adding the first scaled signal to a first channel signal indicative of a first channel of the frame to determine a first channel of the modulated frame, applying the gain to a second modification signal to produce a second scaled signal, and adding the second scaled signal to a second channel signal indicative of a second channel of the frame to determine a second channel of the modulated frame.

19. The system of claim 18, wherein the first modification signal is a sum of the second channel signal and the Hilbert transform of the second channel signal, and the second modification signal is a sum of the first channel signal and the Hilbert transform of the first channel signal.

20. The system of claim 19, wherein the second processing subsystem is configured to determine the gain using an iterative algorithm.

* * * * *